US006988900B1

(12) United States Patent
Meister

(10) Patent No.: US 6,988,900 B1
(45) Date of Patent: Jan. 24, 2006

(54) SURFACE MOUNT CONNECTOR ASSEMBLY

(75) Inventor: Douglas L. Meister, Loganville, GA (US)

(73) Assignee: Scinetific-Atlanta, Inc., Lawrenceville, GA (US)

( * ) Notice: Subject to any disclaimer, the term of this patent is extended or adjusted under 35 U.S.C. 154(b) by 0 days.

(21) Appl. No.: 11/015,404

(22) Filed: Dec. 17, 2004

(51) Int. Cl.
*H01R 12/00* (2006.01)

(52) U.S. Cl. ..... 439/78; 438/83; 438/544; 438/547

(58) Field of Classification Search ..... 439/78, 439/83, 58, 544, 547, 554, 374, 248
See application file for complete search history.

(56) References Cited

U.S. PATENT DOCUMENTS

| | | | | |
|---|---|---|---|---|
| 5,928,031 A | | 7/1999 | Chishima | 439/571 |
| 6,042,386 A | | 3/2000 | Cohen et al. | 439/60 |
| D424,915 S | | 5/2000 | Takase et al. | D8/382 |
| 6,146,184 A | * | 11/2000 | Wilson et al. | 439/374 |
| 6,152,742 A | | 11/2000 | Cohen et al. | 439/60 |
| 6,183,301 B1 | | 2/2001 | Paagman | 439/608 |
| 6,254,429 B1 | | 7/2001 | Morita | 439/570 |
| 6,259,039 B1 | | 7/2001 | Chroneos, Jr. et al. | 174/263 |
| 6,287,130 B1 | * | 9/2001 | Torii | 439/83 |
| 6,334,789 B1 | | 1/2002 | Koyama | 439/570 |
| 6,454,572 B1 | | 9/2002 | Konetski et al. | 439/66 |
| 6,623,203 B2 | | 9/2003 | Kreyenborg et al. | 403/374.3 |
| 6,750,396 B2 | | 6/2004 | Roy | 174/52.1 |
| 6,774,310 B1 | | 8/2004 | Dishongh et al. | 174/94 R |

* cited by examiner

*Primary Examiner*—Tho D. Ta

(57) ABSTRACT

A surface mount connector assembly for mounting to a printed wiring board (PWB) in a low-profile manner. The height of the surface mount connector assembly is diminished because the connector assembly extends from one side of the PWB to the other through an opening in the PWB. The surface mount connector assembly includes an outer housing portion having a plurality of openings therethrough for receiving a plurality of electrical contacts. The surface mount connector also includes an inner housing portion to be nested within the outer housing portion. Each of the electrical contacts are configured to be received within one of the openings in the inner housing portion such that a portion of each contact extends into the interior of the inner housing portion and another portion of each contact extends to the exterior of the inner housing portion. The portion of each contact extending to the exterior of the inner housing portion is positioned between the inner and outer housing portions when the inner and outer housing portions are nested with one another.

17 Claims, 3 Drawing Sheets

SURFACE MOUNT CONNECTOR ASSEMBLY

CROSS-REFERENCE TO RELATED APPLICATIONS

The present U.S. utility application is related to U.S. design applications entitled "SURFACE MOUNT CONNECTOR" and "SURFACE MOUNT CONNECTOR OF INDETERMINATE LENGTH", both to the same inventor, which are incorporated herein by reference, and having been filed concurrently with the present application.

TECHNICAL FIELD

The present invention relates to the field of connectors and, more particularly, relates to the manner in which connectors are mounted on a printed wiring board during the manufacturing process.

BACKGROUND OF THE INVENTION

Electronic devices typically include various types of electrical components such as receptacle-type connector assemblies which are installed during the manufacturing of the electronic device. Some of these receptacle-type connectors are sometimes referred to as a header having a plurality of electrical contacts or pins within. The header is configured to correspond with and retain a female socket which is, in turn, configured to receive the header's plurality of contact pins. Typically, connector pins are soldered to the printed wiring board (PWB) as shown in FIG. 1 using a wave solder process where the PWB and any headers to be attached are passed through a bath of solder. Once the header is soldered to the PWB and the corresponding socket is to be connected, the cable such as a ribbon cable must extend from the side of the PWB having the header to the opposite side of the PWB which is undesirable.

Some other types of connectors, commonly referred to as surface mount connectors because they sit on only one side of the PWB, without contacts extending to the opposite side of the PWB as shown in FIG. 2, allow the ribbon cable to extend from only one side of the PWB. This configuration has been more desirable because the ribbon cable is not wrapped around the PWB from one side to the other. However, these known surface mount connectors are too tall to pass through the wave solder machine when being mounted to a single-sided PWB because of the addition height created by having the contacts extend between the PWB and the header.

Therefore, what is needed is a means to mount surface mount connectors to single-sided PWBs in a low-profile manner such that the PWB and the surface mount connectors to be mounted may pass through the solder wave machine without being obstructed. Moreover, the ribbon cable should preferably extend from only one side of the PWB.

BRIEF DISCRIPTION OF THE DRAWINGS

DETAILED DESCRIPTION

The present invention will be described more fully hereinafter with reference to the accompanying drawings in which like numerals represent like elements throughout the several figures, and in which an exemplary embodiment of the invention is shown. This invention may, however, be embodied in many different forms and should not be construed as being limited to the embodiments set forth herein; rather, the embodiments are provided so that this disclosure will be thorough and complete, and will fully convey the scope of the invention to those skilled in the art. The present invention is described more fully hereinbelow.

Figure 1:
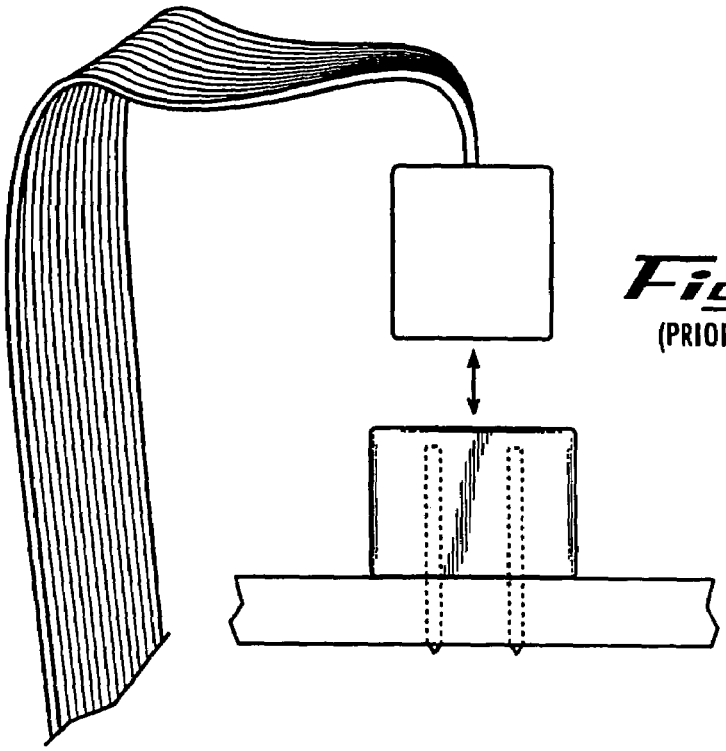
Fig. 1 (PRIOR ART)
FIG. 1 illustrates a front view of a prior art connector mounted on a PWB receiving a corresponding socket-type connector where the contacts pass through to the opposite side of the PWB.
Figure 2:
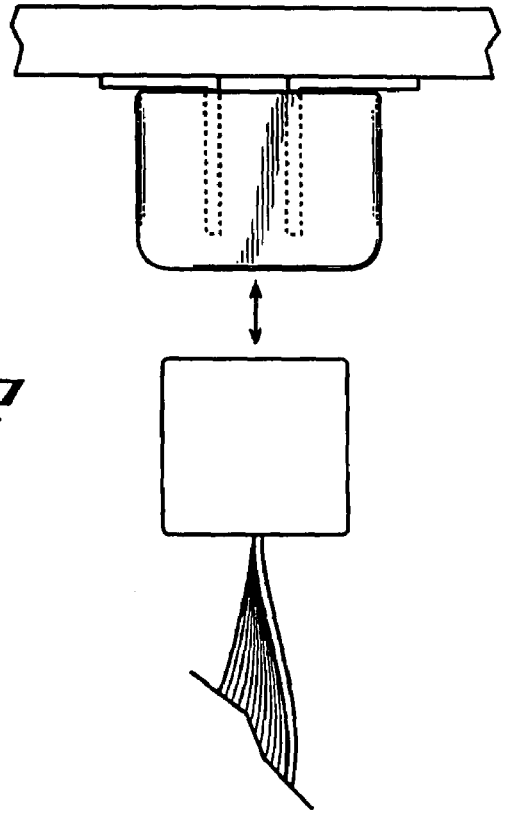
Fig. 2 (PRIOR ART)
FIG. 2 illustrates a front view of a prior art surface mounted connector on a PWB receiving a corresponding socket-type connector where the contacts do not pass through to the opposite side of the PWB.
Figure 3:
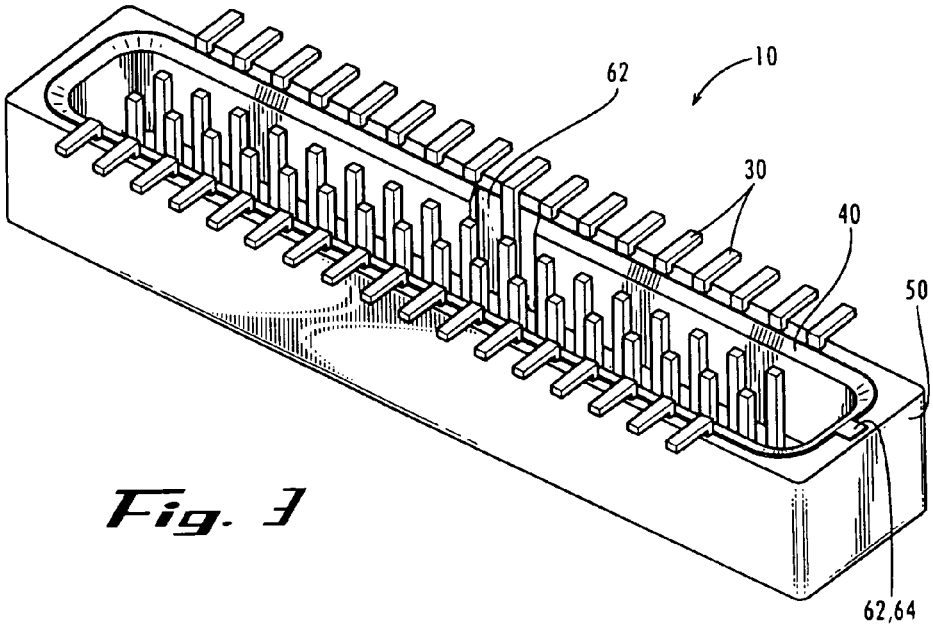
FIG. 3 illustrates a perspective view of one embodiment of a surface mount connector assembly of the present invention.
Figure 4:
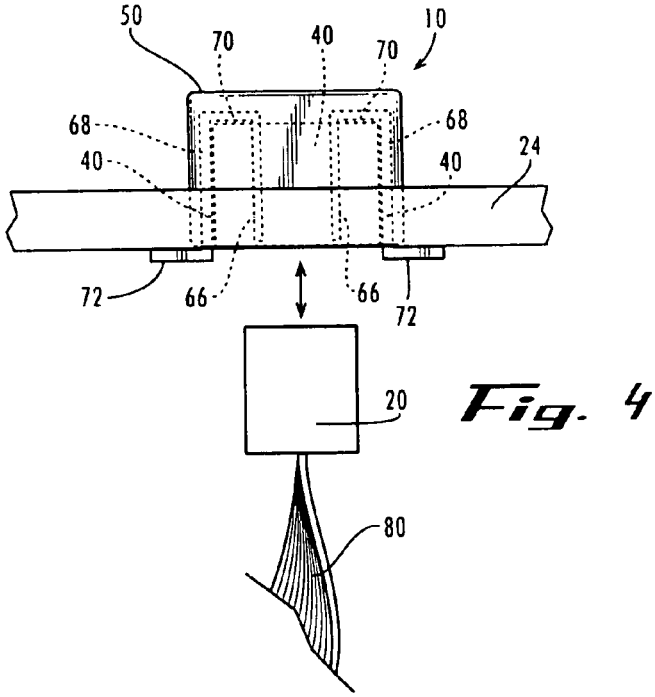
FIG. 4 illustrates a front view of one embodiment of the surface mount connector assembly of FIG. 3 connected to only one side of the PWB according to the present invention.

FIG. 3 illustrates a perspective view of one embodiment of a surface mount connector assembly 10 of the present invention. The surface mount connector assembly 10 is configured to receive and retain a corresponding socket connector 20 as shown in FIG. 4. The connector assembly 10 may be mounted to one side of a printed circuit board (PCB) or a printed wiring board (PWB) 24 without electrical contacts 30 (FIG. 7) extending from one side of the PWB 24 to the other in order to solder the connector assembly to the PWB 24. The surface mount connector assembly 10 is mounted in a low profile manner to facilitate the passing of the connector assembly 10 and the PWB 24 through the solder machine in an unobstructed manner.

Figure 5:
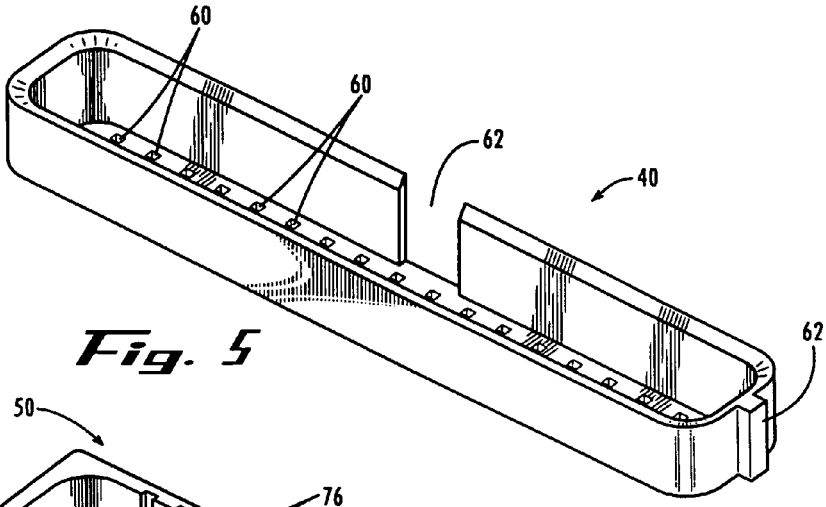
FIG. 5 illustrates a perspective view of one embodiment of an inner housing portion of the surface mount connector assembly of the present invention.
Figure 6:
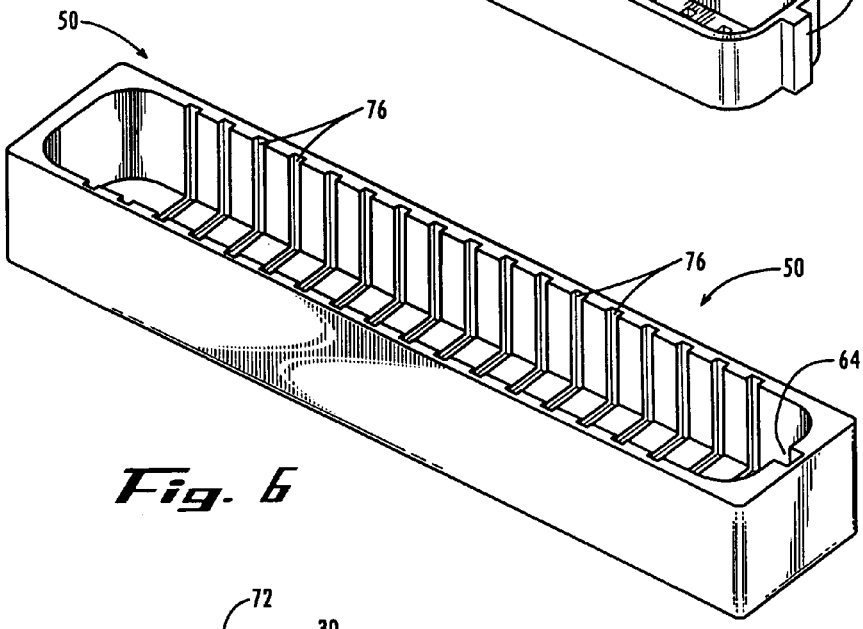
FIG. 6 illustrates a perspective view of one embodiment of an outer housing portion of the surface mount connector assembly of the present invention.

The connector assembly 10, in addition to electrical contacts 30, further includes an inner housing portion 40, as shown in FIG. 5, and an outer housing portion 50, as shown in FIG. 6, which together define a body of the connector assembly 10. The inner and outer housing portions 40, 50 are preferably made of Pollybutylene Terephalateor, commonly referred to as PBT (30% glass filled), with a UL rating of UL94V-0, or some other suitable material such as a heat resistant plastic. Each of the housing portions 40, 50 have side walls and a bottom to define a housing interior.

Figure 7:
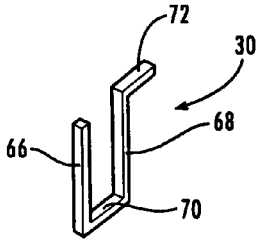
FIG. 7 illustrates a perspective view of one embodiment of one of a plurality of electrical contacts of the surface mount connector assembly of the present invention.

In order to assemble the surface mount connector assembly 10 of the present invention, the contacts 30, shown in FIG. 7, are each received in an opening 60 in the bottom of the inner housing portion 40. The inner housing portion 40 preferably includes two parallel and aligned rows of openings 60 where the openings 60 within each row are equally spaced from one another. Also, each opening 60 in one row of openings is aligned with an opening of the other row.

As best shown in FIG. 5, one side of the inner housing 40 includes a break 62 which extends preferably the full height of the side of the inner housing 40. The break 62 in the side of the inner housing 40 may be referred to as a slot for receiving a tongue portion (not shown) of the corresponding socket connector once the connector assembly is fully assembled. Preferably, as best shown in FIG. 3, the inner and outer housing portions 40, 50 are keyed to one another such as with a protruding tongue portion 62 and a corresponding slot 64.

The surface mount connector assembly 10 of the present invention may include any number of contacts 30 which are preferably shaped as shown in FIG. 7. In one embodiment, as shown in FIG. 7, each of the contacts 30 includes a pair of vertical portions 66 and 68, which are spaced from one another, and a pair of horizontal portions 70 and 72, which are also spaced from one another. The two vertical portions 66, 68 are preferably parallel to and aligned with one another. The two horizontal portions 70, 72 are also parallel to one another, but misaligned. The horizontal portion 70 is connected between the two vertical portions 66, 68 and an end of the other horizontal portion 72 is connected to the vertical portion 68 so that the horizontal portion 72 extends outward from the vertical portions 66, 68. Therefore, portions 66, 68, 70 and 72 are connected to one another, in an alternating manner, and in series, to form a shape which turns back on itself.

The outer housing portion 50 includes a corresponding number of grooves 76, as best shown in FIG. 6, to receive the contacts 30. Each of the grooves 76 extend the full inside height of each of the opposite sides of the outer housing portion 50 as well as across the full inside width of the bottom of the outer housing portion 50 as best shown in FIG. 6. Preferably, the configuration of each of the grooves 76 corresponds to the configuration of each of the contacts 30. As shown in FIGS. 6 and 7, the contacts 30 and grooves 76 have substantially rectangular cross-sections across their entire lengths. However, each may be shaped differently from one another so long that the contacts 30 may be received and retained within the inner and outer housing portions 40, 50 once nested with one another.

Once all of the contacts 30 are received within the openings 60, the distal ends of the vertical portions 66 of the contacts 30 protruding from each of the openings 30 form two rows within the inner housing portion 40. The horizontal portions 70 of the contacts extend across the exterior of the bottom of the inner housing portion 40. The vertical portions 68 of one row of contacts 30 extend across the exterior of one side of the inner housing portion 40 and the vertical portions 68 of the other row of contacts 30 extend across the exterior of the other side of the inner housing portion 40. The vertical portions 68 and horizontal portions 70 extending along the exterior of the inner housing portion 40 are accommodated by the grooves 76 when the inner and outer housing portions 40, 50 are nested with one another. The horizontal portions 72 of the contacts 30 extend outwardly from the edge of the inner housing portion 40 in a manner preferably substantially perpendicular to the sides of the inner housing portion 40 and parallel misaligned with the bottom of the inner housing portion 40. Once the inner and outer housing portions 40, 50 are nested with one another, only the vertical portions 66 of the contacts 30 and the horizontal portions 72 of the contacts 30 are visible which will allow the distal ends of the horizontal portions 72 to be soldered to the PWB 24 and then the distal ends of the vertical portions 66 to be received in the corresponding socket connector.

Referring back to FIG. 4, the PWB 24 includes an opening or through-hole sized to receive the outer housing portion 50, with the inner housing portion 40 nested within. Once received within the opening, the body of the surface mount connector 10 extends from one side of the PWB 24 to the other. The horizontal portions 72 of the electrical contacts 30 to be soldered to the PWB are on one side of the PWB 24 while the other horizontal portions 70 are on the opposite side of the PWB. The length of the two vertical portions 66, 68 of the electrical contacts 30 substantially pass through the thickness of the PWB 24. Therefore, the difference in height in which the connector assembly 10 extends from the PWB 24 is diminished by an amount equal to the thickness of the PWB 24 which then allows the PWB 24 and the surface mounted connector assembly 10 to pass through the solder wave machine unobstructed. Moreover, as shown in FIG. 4, a cable such as a ribbon cable 80 would not be required to extend from one side of the PWB 24 to the other.

The foregoing has broadly outlined some of the more pertinent aspects and features of the present invention. These should be construed to be merely illustrative of some of the more prominent features and applications of the invention. Other beneficial results can be obtained by applying the disclosed information in a different manner or by modifying the disclosed embodiments. Accordingly, other aspects and a more comprehensive understanding of the invention may be obtained by referring to the detailed description of the exemplary embodiments taken in conjunction with the accompanying drawings, in addition to the scope of the invention defined by the claims.

In the claims:

1. A surface mount connector assembly for mounting to a printed wiring board (PWB), said surface mount connector assembly comprising:

an inner housing portion having a plurality of openings therethrough;

an outer housing portion defining an interior said inner housing portion nested within said outer housing portion; and a plurality of electrical contacts, each said contact configured to be received within one of said openings in said inner housing portion such that a portion of each said contact extends into the interior of said inner housing portion and another portion of each said contact extends to the exterior of said inner housing portion, and said portion of each said contact extending to the exterior of said inner housing portion positioned between said inner and outer housing portions when said inner and outer housing portions are nested with one another.

2. The connector assembly of claim 1 wherein each said contact comprises a pair of vertical portions and a pair of horizontal portions which are alternately connected to one another in series.

3. The connector assembly of claim 1 wherein each said contact comprises a pair of vertical portions and a pair of horizontal portions, one of said horizontal portions connected between said pair of vertical portions where said vertical portions are parallel and aligned with one another, and the other of said horizontal portions connected to an end of one of said vertical portions such that said horizontal portions are parallel and misaligned with one another.

4. The connector assembly of claim 1 wherein a cable coupled to said connector assembly extends to only one side of the PWB.

5. The connector assembly of claim 1 wherein an interior of said outer housing portion comprises a plurality of grooves, each said groove configured to accommodate portions of one of said contacts when said inner and outer housing portions are nested within one another.

6. The connector assembly of claim 1 wherein said connector assembly extends from one side of the PWB to the other through an opening in the PWB when mounted to the PWB.

7. The connector assembly of claim 6 wherein said opening in the PWB conforms to the exterior of said outer housing portion.

8. The connector assembly of claim 6 wherein each said contact extends from one side of the PWB to the other side of the PWB through said opening in the PWB and then turns back on itself in order to pass back through at least a portion of said opening in the PWB.

9. The connector assembly of claim 6 wherein a first end of each said contact is soldered to one side of the PWB and a second end of each said contact extends through said opening in the PWB from the other side of the PWB and toward the one side of the PWB.

10. The connector assembly of claim 1 wherein said contacts extending through said openings of said inner housing portion extend along the exterior of said inner housing portion along a bottom of said inner housing and along a side of said inner housing portion.

11. The connector assembly of claim 10 wherein said contacts extending through said openings of said inner housing portion extend along the exterior of said inner housing portion along a bottom of said inner housing and along a side of said inner housing portion, and wherein an interior of said outer housing comprises a plurality of grooves, each said groove receiving portions of one of said contacts extending along the exterior bottom and side of said inner housing portion when said inner and outer housing portions are nested with one another.

12. A surface mount connector assembly for mounting to a printed wiring board (PWB), said surface mount connector assembly comprising:

a body having an inner housing portion and an outer housing portion configured to be nested with one another and said inner housing portion having a plurality of openings therethrough; and a plurality of electrical contacts, each said contact configured to be received within one of said openings in said inner housing portion of said body such that a portion of each said contact extends into said interior of said body, wherein said body of said connector assembly when mounted to the PWB extends from one side of the PWB to the other through an opening in the PWB.

13. The connector assembly of claim 12 wherein said opening in the PWB conforms to the exterior of said outer housing portion.

14. The connector assembly of claim 12 wherein each said contact comprises a pair of vertical portions and a pair of horizontal portions, one of said horizontal portion connected between said pair of vertical portions where said vertical portions are parallel and aligned with one another, and the other of said horizontal portions connected to an end of one of said vertical portions such that said horizontal portions are parallel and misaligned with one another.

15. The connector assembly of claim 12 wherein a cable coupled to said connector assembly extends to only one side of the PWB.

16. The connector assembly of claim 12 wherein an interior of said outer housing portion comprises a plurality of grooves, each said groove configured to accommodate portions of one of said contacts when said inner and outer housing portions are nested with one another.

17. The connector assembly of claim 12 wherein said contacts extending through said openings of said inner housing portion extend along the exterior of said inner housing portion along a bottom of said inner housing and along a side of said inner housing portion.

* * * * *